US005344136A

United States Patent [19]

Capdeboscq

[11] Patent Number: 5,344,136

[45] Date of Patent: Sep. 6, 1994

[54] SHEET SUPPORTING ARRANGEMENT FOR USE IN A STACKER

[75] Inventor: Bernard Capdeboscq, St. Just-Chaleyssin, France

[73] Assignee: SA Martin, Villeurbanne, France

[21] Appl. No.: 82,974

[22] Filed: Jun. 29, 1993

[30] Foreign Application Priority Data

Jul. 3, 1992 [FR] France ..... 92 08679

[51] Int. Cl.[5] ..... B65H 31/26

[52] U.S. Cl. ..... 271/189; 271/166; 271/218

[58] Field of Search ..... 271/166, 189, 192, 218

[56] References Cited

U.S. PATENT DOCUMENTS 3,285,605 11/1966 Vasse ..... 271/166
4,511,136 4/1985 Yamada ..... 271/189 X
4,531,724 7/1985 Lukas ..... 271/166
4,547,112 10/1985 Steinhart .
5,201,513 4/1993 Mion .

FOREIGN PATENT DOCUMENTS 0153983 9/1985 European Pat. Off. .
1957337 6/1970 Fed. Rep. of Germany .

*Primary Examiner*—Richard A. Schacher
*Attorney, Agent, or Firm*—Hill, Steadman & Simpson

[57] ABSTRACT

A sheet supporting arrangement comprises an upper sheet supporting grid and a lower sheet supporting grid, each made up of rods of jacks which are arranged on front and rear walls of a stacker. The upper grid consists of a series of jacks, each comprising an elastically, though not permanently deformable rod which is set at one of its ends in a piston that is also elastically, though not permanently deformable. The elastically, though not permanently rod is then guided within a bearing when it moves as well as by the circumferential surface of the piston sliding on the inner cylindrical surface of the cylinder forming the jack.

6 Claims, 3 Drawing Sheets

SHEET SUPPORTING ARRANGEMENT FOR USE IN A STACKER

BACKGROUND OF THE INVENTION

The present invention is directed to a sheet supporting arrangement to be used in a stacker, especially a stacker which is designed to receive die-cuts, boards or paperboard boxes. The stacker comprises an upper and lower sheet support grid made up of rods of jacks or actuators which are arranged on a front and rear wall of the stacker.

in practical use, stackers for corrugated board sheets are known to work jointly with belts carrying the sheets up to the stacker. These carrying belts are generally arranged so as to drop the sheets on top of the stacker in which the sheets will fall due to the force of gravity.

A stacker of this type is described in U.S. Pat. No. 5,201,513, whose disclosure is incorporated herein by reference thereto and which claims priority from French Patent Application 91 02522. The stacker in this patent includes, among other elements, a front and rear wall on which jacks or pneumatic actuators are arranged. The actuators have rods, and when put in a forward position, the rods make up a first sheet supporting grid which allows the removal of the first sheet piled previously built up on a second supporting grid also made up of rods of other pneumatic jacks equally arranged on the front and rear walls. The removal of the pile thus built up on the second grid is ensured by a roller carrier once the rods of the jacks of the second grid have been retracted to a retracted position to allow the stack to drop onto the roller carrier.

The jacks used in the above-mentioned device are conventional jacks which are sold on the market. More specifically, their rods are of metal and, hence, very rigid.

In use, it has been noticed that when a jam occurs in the course of a high-speed job, the rigidity of the metal rods constitutes a disadvantage that was non-neglectable by the fact that the accumulation of sheets between the first grid made up of rods of the jacks, which is the upper grid, and the carrier belts was causing considerable damage to the rods of the pneumatic jacks. This damage went, in some cases, to actual breaking of the rods. Moreover, the action of setting the device back into operation after a jam occurred proved to be very difficult, due to the squeezing or pressing of sheets between the grid and the carrier belts, which squeezing or pressing impairs the easy retraction of the rods of each of the pneumatic jacks. Thus, the rods would be more or less bent or squeezed in their guide-pieces of the respective jacks.

In certain cases, the rods of the jacks have even suffered permanent deformation to such a degree that it was almost impossible to retract the rods back into the jacks.

SUMMARY OF THE INVENTION

The present invention is directed to an object of eliminating the above-mentioned drawbacks by giving a solution to the problem of permanent deformation of the rods of the pneumatic jacks when a jam occurs in the stacker.

To accomplish this aim, in accordance with one of the aspects of the present invention, the sheet supporting arrangement is made up of several actuators or jacks, each comprising an elastically, though not permanently deformable rod which is set at its one end in a piston that is also elastically, though not permanently deformable. The elastically, though not permanently deformable rod is guided in a bearing when it moves, as well as by a circumferential surface of the piston sliding in the skirt of the cylinder for the jack or actuator.

According to another embodiment of the invention, the elastically, though not permanently deformable rod of every jack is guided in a smooth bearing when it moves. Advantageously, the elastically, though not permanently deformable rod is guided into a two-piece bearing which has a degree of swivel or rotation.

Preferably, the rod is made of a thermoplastic polyester and the piston is made of a thermoplastic polyester.

It has been advantageous, owing to the present invention, wherein the possible jams occur in the course of piling up of the corrugated board sheets on the rods of the jacks, the rods are not deteriorated and, hence, no replacement of damaged rods will be necessary. Consequently, the use of the supporting arrangement according to the present invention assures a better yield of the piling device due to the easy and quick action of setting this piling device back into operation after a premature jam occurs.

Other advantages and features of the invention will be readily apparent from the following description of the preferred embodiments, the drawings and claims.

DESCRIPTION OF THE PREFERRED EMBODIMENTS

Figure 1:
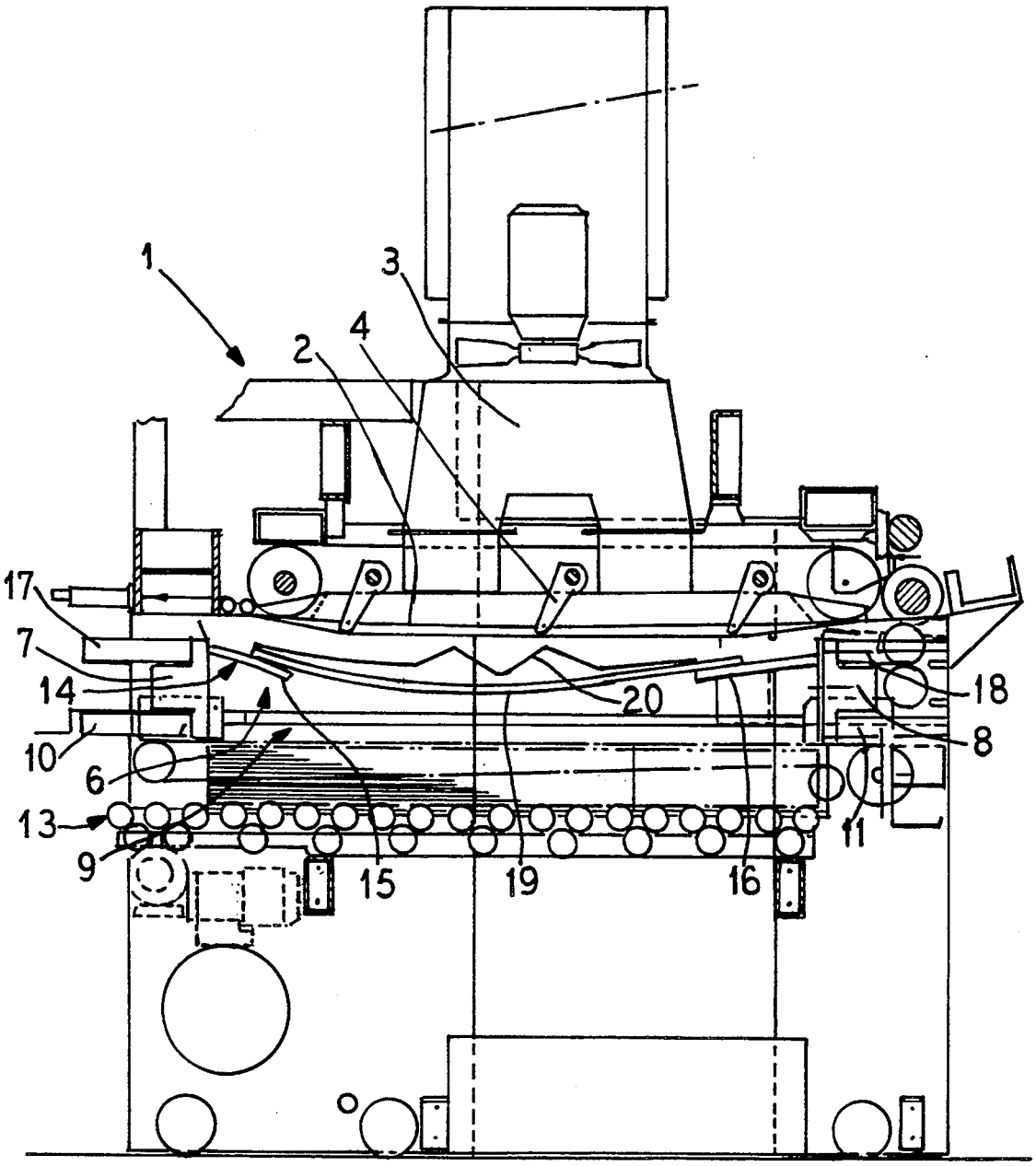
FIG. 1 is a schematic side view of a stacking or piling device in accordance with the present invention.

The principles of the present invention are particularly useful when incorporated in a piling or stacking device, generally indicated at 1 in FIG. 1. The stacking or piling device 1 comprises a series of carrier belts 2 that cooperate with a sucking device 3 to transport a sheet of cardboard into the stacking device. To eject the corrugated cardboard sheet from the belts 2, a plurality of ejecting arms or elements 4 are rotated to the position illustrated in FIG. 1 to push the sheet out of engagement with the belts so that it may drop into a stacker 6. The corrugated cardboard sheets that are received from the processing machine, which is located upstream of the device 1, are carried by the belts 2 up to the stacker 6 that consists of a front wall 7, as well as a rear wall 8. The sheets will be piled after having been separated from the carrier belts 2 by means of the ejecting arms 4.

In a first phase, the corrugated sheets will be piled onto a lower grid, generally indicated at 9, which is made up by rods of the pneumatic jacks or actuators 10 and 11. The rods of these jacks are placed in the retracted position, since the corrugated board pile sheet is already built-up, as shown, and is in its removal phase on a roller carrier 13, which is disposed therebeneath, As may be gathered from FIG. 1, an upper grid 14 is made up by metal rods 15 and 16 of the jacks 17 and 18, which are arranged in the lower neighborhood of the carrier belts 2 so as to support the corrugated board sheets arriving in the piling device during the period of time which is necessary for the removal of the pile which has already been built up.

The kind of piling device which has just been described works at high speeds and premature jamming may sometimes occur, due to, for instance, an unsuitable sheet or a damaged one arriving in the device.

An accumulation of the sheets can take place between the carrier belts 2 and the upper grid formed by the rods 15 and 16, which support the sheet, such as 19. The accumulation of sheets is shown symbolically by a damaged sheet 20.

The corrugated boards are of a material which is rather resistant, and accumulation between the carrier belts 2 and the rods 15 and 16 of the upper grid 14 will generate important stresses on the rods 15 and 16 and even cause them to be permanently deformed, if not broken. As represented in FIG. 1, the metal rods 15 and 16 are bent under the jam effect, and it is obviously understandable that it will be impossible to actuate the jacks 17 and 18 in order to withdraw the rods 15 and 16 and to re-establish normal operating conditions just by eliminating the sheets squeezed between the rods 15 and 16 and the carrier belts 2. An entire dismantling of this part of the piling device 1 will then be necessary and it will take a lot of time to re-establish the situation. In the event of permanent deformation of the rods 15 and 16 or irreparable damage, it may even be necessary to replace the jack or jacks concerned.

Figure 2:
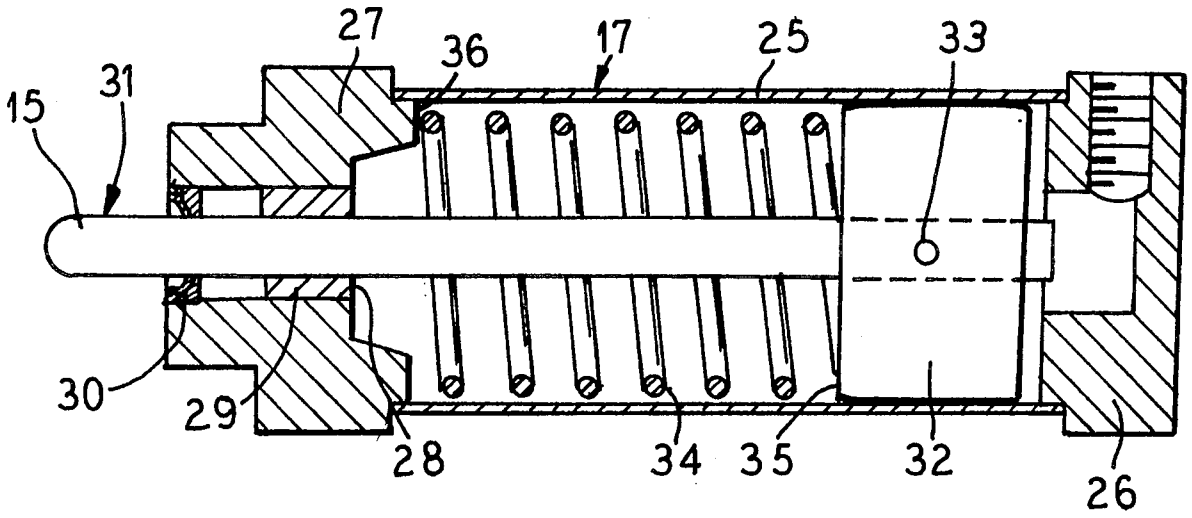
FIG. 2 is an enlarged longitudinal cross section of a jack or actuator utilized as a retractable supporting element in the piling device of FIG. 1.

In the present invention, the jacks or actuators, such as 17 and 18, which form the upper grid 14, will be constructed like the jack 17 of FIG. 2. The jack 17 of FIG. 2 includes a cylinder 25 which is shut, or closed at one end by a sleeve or cap 26, through which the delivery of a fluid for the jack is achieved. In the present case, the fluid used consists of compressed air. The other end of the cylinder 25 is also shut or closed by another sleeve or cap 27 in which a smooth bearing 28 is arranged in order to serve as a guide for the rod 15 of the actuator 17. The smooth bearing consists, preferably, of a bushing 29 and a tightening seal 30.

The rod 15 is a cylindrical rod with mechanical characteristics that allow a non-permanent deformation when the rod is placed under radial stress, which is shown in the direction of the arrow 31. As explained before, the stress on the rods which make up the upper grid will essentially be caused due to forces generated by the accumulation of corrugated sheets between the carrier belts 2 and the grid 14, which is formed by the rods, such as 15 and 16. The rod 15 is preferably made of a synthetic material, such as a thermoplastic polyester, but it can also be feasible to form it of a mechanical member. Such a mechanical member would be a spring with a flat closed spiral surrounded by a cover that will insure an acceptable movement of the rod in the smooth bearing 28.

In the exemplary embodiment of FIG. 2, the rod 15 is attached to a piston 32 where it is made fast by means of a pin, such as 33. In this execution, the piston 32 is also made of a thermoplastic polyester so as to be also somewhat deformable at the time stress is applied to the rod 15, particularly when the latter is in the forward or extended position, which position is caused by supplying air through the passage in the end cap 26 to act on the piston 33 to move it against the force of the spring 34. When the pressure of air is released, the spring will move the piston back to the retracted or illustrated position to withdraw the rod, such as 15. As illustrated, the spring 34 acts on the side 35 of the piston 32 and on a side 36 of the end cap 27. Instead of providing a spring 34, it is possible to provide an air passage in the end cap 27 so that the piston is a double-acting piston.

Figure 3:
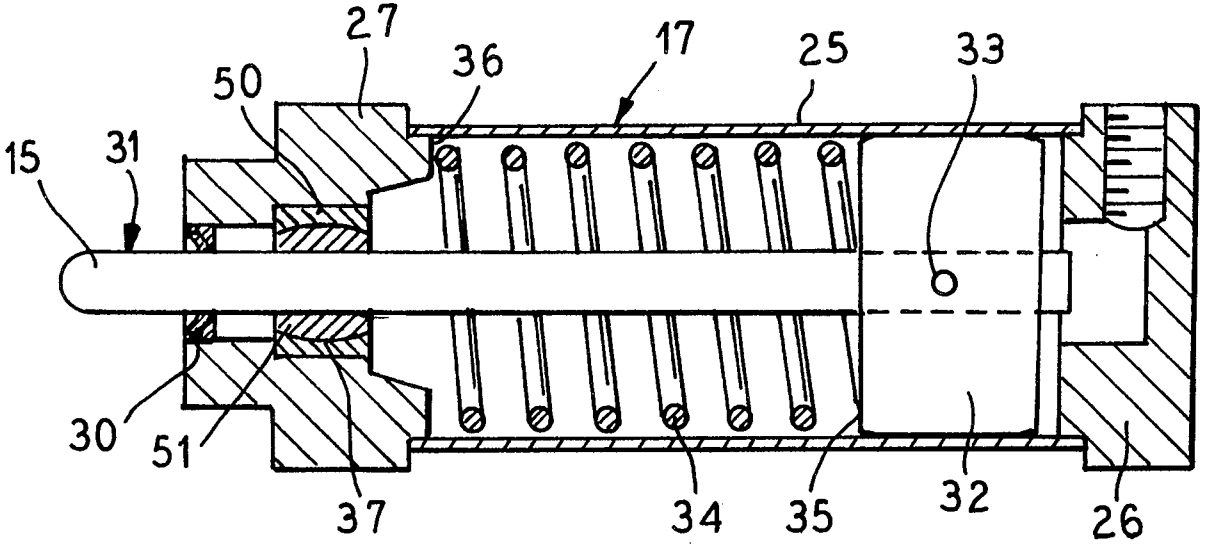
FIG. 3 is a transverse cross sectional view similar to FIG. 2 of an embodiment of the jack or actuator used as a supporting element.

In FIG. 3, a modification is illustrated for a jack or actuator 17'. In this modification, identical parts have the same element number. In the modification, the guiding bearing for the rod 15, which is provided in the sleeve 27, is a swivel bearing 37 which has two parts 50 and 51. The part 51 is able to swivel or rotate within the part 50 to allow compensation for any bending stresses placed on the rod 15, such as by a force acting in the direction of the arrow 31.

In both embodiments, the rod is able to deform elastically without any permanent deformation occurring. Thus, when a jam occurs, the rod can relieve some of the stresses by elastically deforming. Once the jam has been removed to remove the forces acting in a radial direction on the rods, the rods will resume their regular position and, therefore, are able to be retracted back into the cylinder of the actuator.

Although various minor modifications may be suggested by those versed in the art, it should be understood that I wish to embody within the scope of the patent granted hereon all such modifications as reasonably and properly come within the scope of my contribution to the art.

I claim:

1. In a sheet supporting arrangement for a stacker which stacks sheets and comprises a front wall and a rear wall, a plurality of actuators mounted on the front and rear wall, each actuator having a cylinder receiving a piston with a piston rod, said rods forming an upper support grid, the improvements comprising each actuator of the upper grid comprising an elastically, though not permanently deformable rod which is set at one of its ends in the piston that is also elastically, though not permanently deformable and each rod being guided by a bearing and by the circumferential surface of the piston sliding in the inner wall of the cylinder of the jack as the rod moves between an extended and retracted position.

2. In a sheet supporting arrangement according to claim 1, wherein each of the actuators has a smooth bearing for supporting and guiding the rod.

3. In a sheet supporting arrangement according to claim 2, wherein each of the smooth bearings is a two-piece bearing which allows one piece to swivel relative to the other to compensate for bending forces applied on the rod.

4. In a sheet supporting arrangement according to claim 1, wherein the rod of each actuator is made of a thermoplastic polyester.

5. In a sheet supporting arrangement according to claim 4, wherein the piston of each actuator is also made of a thermoplastic polyester.

6. In a sheet supporting arrangement according to claim 1, wherein each of the pistons is made of a thermoplastic polyester material.

* * * * *